US008820368B2

(12) United States Patent
Stewart-Stand

(10) Patent No.: US 8,820,368 B2
(45) Date of Patent: Sep. 2, 2014

(54) WALLET COMPOSED OF STEEL FABRIC

(75) Inventor: Theo Stewart-Stand, Goldens Bridge, NY (US)

(73) Assignee: Paul Stewart-Stand, Carlsbad, CA (US)

( * ) Notice: Subject to any disclaimer, the term of this patent is extended or adjusted under 35 U.S.C. 154(b) by 68 days.

(21) Appl. No.: 13/350,986

(22) Filed: Jan. 16, 2012

(65) Prior Publication Data

US 2012/0111953 A1 May 10, 2012

Related U.S. Application Data

(63) Continuation of application No. 12/685,320, filed on Jan. 11, 2010, now abandoned, which is a continuation of application No. 11/581,711, filed on Oct. 16, 2006, now abandoned.

(60) Provisional application No. 60/750,037, filed on Dec. 13, 2005.

(51) Int. Cl.
*A45C 1/06* (2006.01)
*A45C 11/18* (2006.01)

(52) U.S. Cl.
CPC ..... *A45C 1/06* (2013.01); *A45C 2011/186* (2013.01)
USPC ..... 150/131; 150/132; 150/133; 150/138; 150/139; 150/151; 150/145; 150/147

(58) Field of Classification Search
CPC ..... A45C 1/06; A45C 3/00; A45C 3/06; A24F 15/12; A24F 17/00
USPC ..... 150/131, 132, 133, 138, 139, 151, 145, 150/147; 340/10.1, 568.7, 572.1, 572.8
See application file for complete search history.

(56) References Cited

U.S. PATENT DOCUMENTS

| | | | | |
|---|---|---|---|---|
| 2,544,341 | A * | 3/1951 | McGraw | 119/869 |
| 7,261,133 | B1 * | 8/2007 | Copeland | 150/145 |
| 2004/0108032 | A1 * | 6/2004 | Lyons | 150/132 |
| 2006/0044206 | A1 * | 3/2006 | Moskowitz et al. | 343/841 |
| 2008/0190526 | A1 * | 8/2008 | O'Shea | 150/147 |

* cited by examiner

*Primary Examiner* — Fenn Mathew
*Assistant Examiner* — Cynthia Collado
(74) *Attorney, Agent, or Firm* — Andrew Wilford

(57) ABSTRACT

A smart card with an RFID tag is held in a wallet comprising a back layer and at least one front layer stitched to the back layer around part of a perimeter thereof to define at least one pocket in the wallet dimensioned to hold and completely surround the smart card. Both of the layers are composed of a stainless steel fabric capable of blocking RF radiation.

7 Claims, 8 Drawing Sheets

WALLET COMPOSED OF STEEL FABRIC

CROSS REFERENCE TO RELATED APPLICATION

This application is a continuation of application Ser. No. 12/685,320 filed 11 Jan. 2010 as a continuation of now abandoned application Ser. No. 11/581,711 filed 16 Oct. 2006 in turn filed as a replacement of provisional application 60/750,037 filed 13 Dec. 2005.

FIELD OF THE INVENTION

The present invention relates to a wallet made of stainless steel fabric.

BACKGROUND OF THE INVENTION

Wallets made of fabric and leather are, of course, known. The durability of the wallet has been recognized as a function of the material from which it is composed. While leather is widely used for this purpose, even after being folded a few times, the wallet shows signs of wear. Textile fabric wallets are even more prone to wear.

OBJECT OF THE INVENTION

It is the object of the invention to provide an improved wallet with greater durability then leather or textile fabric wallets and even wallets made from plastic sheet materials, with unique esthetic properties and lightweight material.

SUMMARY OF THE INVENTION

The wallet of the invention comprises a back layer and at least one front layer stitched to the back layer around a part of a perimeter thereof to define at least one pocket in the wallet. At least one of the layers is composed of a stainless steel fabric and preferably all of the layers are composed of stainless steel fabric. The threads of which the woven stainless steel fabric is composed are preferably of an Inox alloy, especially Inox 316L stainless steel with a metric mesh number between 350 and 550 and composed of stainless steel threads with a thickness generally of 0.25 mm to 0.35 mm. More preferably, the mesh number is 440 and the thread thickness is 0.28. A plurality of front layers can be stitched to the back layer with cotton thread, thread of a synthetic resin, for example, polyester, but most preferably, stainless steel threads.

Such a wallet has proven extraordinarily durable, and is even considered very attractive with a so-called high-tech look.

Another enormous surprising advantage of such a wallet is that is provides radio-frequency shielding for the wallet contents. This is extremely handy when a user is carrying a so-called smart card of the type capable of actually emitting a radio-frequency signal when appropriately queried, or a so-called RFID (radio-frequency identification) tag. Such cards are increasing used, for instance they can be set up so that, as a bearer approaches his/her vehicle, the vehicle, which periodically emits an r-f query, can determine that the bearer is nearby and unlock the doors and even, in some cases, turn the vehicle's lights on and start the engine. An RFID tag can also allow its bearer to be tracked. All such devices, when put in the wallet according to the invention, are effectively shielded and rendered temporarily ineffective.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
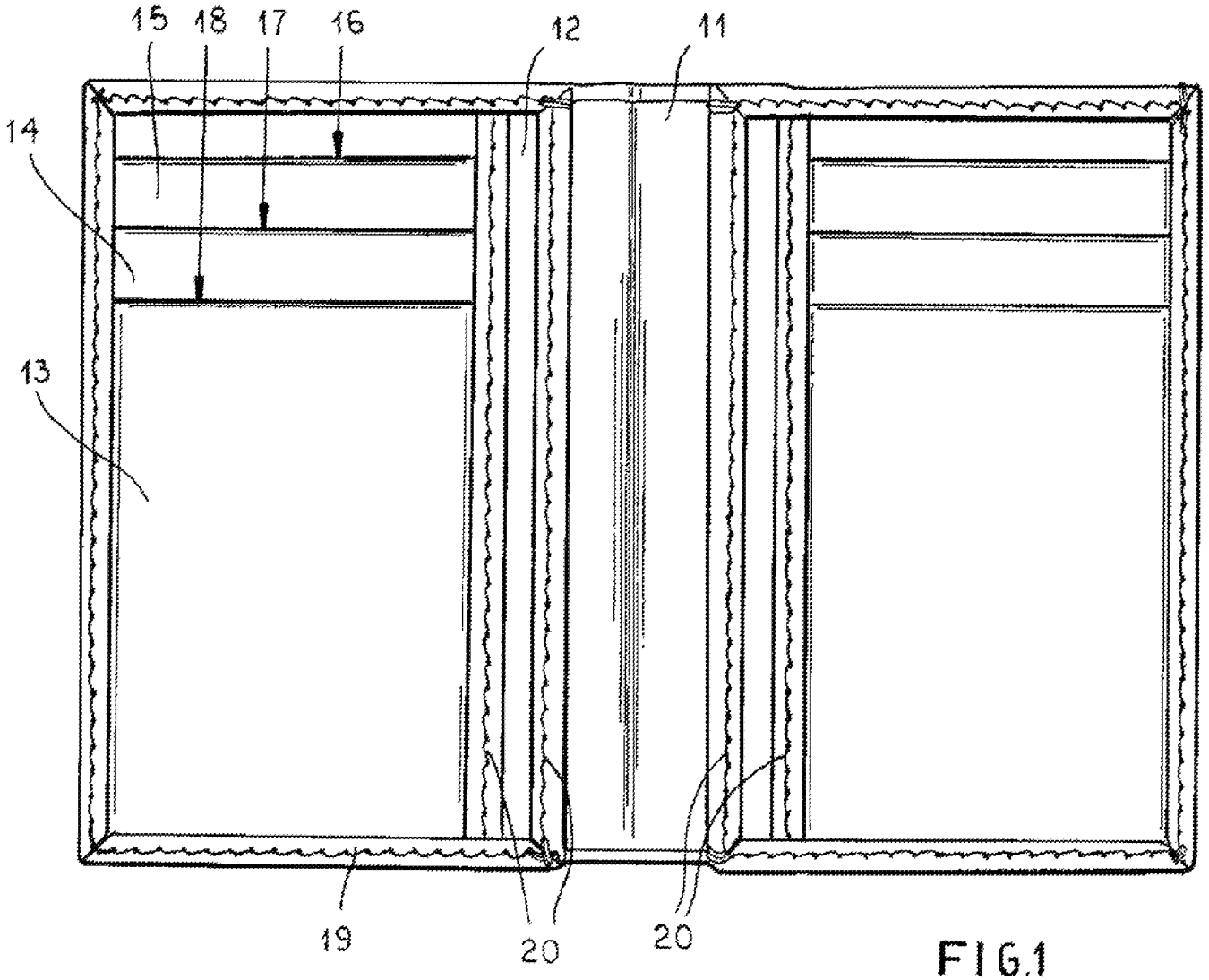
FIG. 1 is a front view of a wallet according to the invention.
Figure 2:
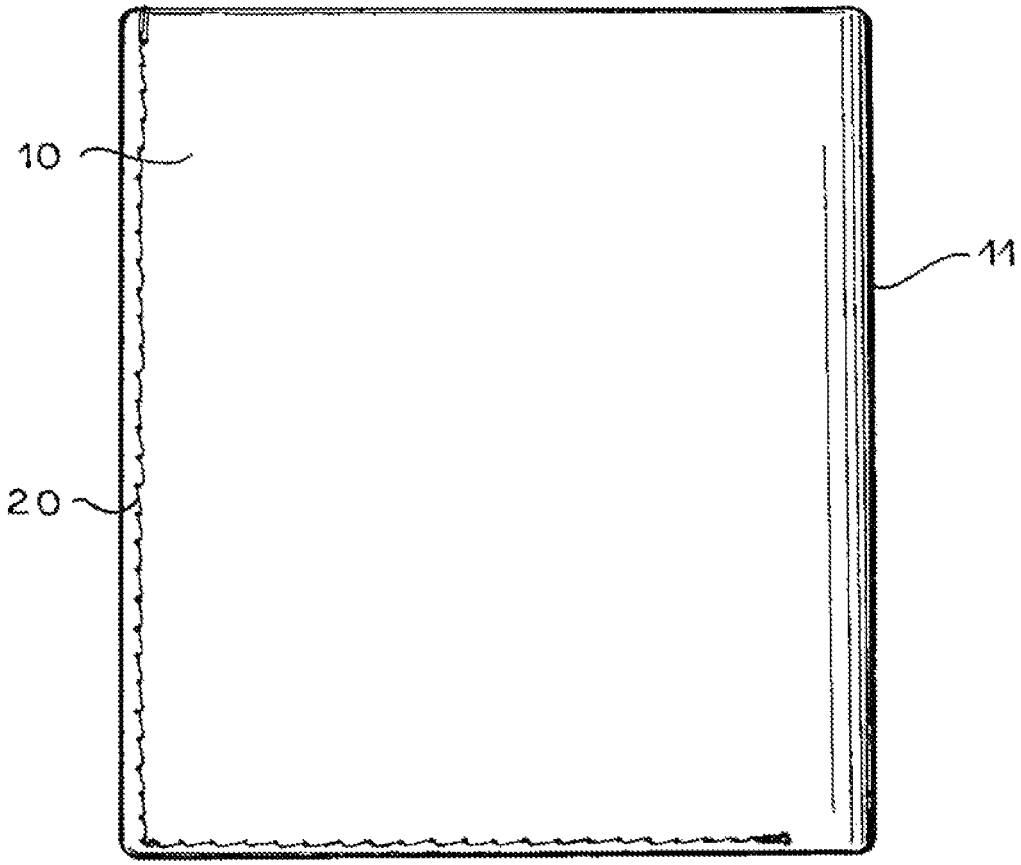
FIG. 2 is a view of the folded wallet.

The wallet of FIG. 1 comprises a rectangular back layer 10 which can be provided with a fold at 11 and to which front layers 12, 13, 14 and 15 can be attached on each side to form a number of pockets, openings into which are represented at 16, 17 and 18. The edges may be turned inwardly at 19 and stitching is shown at 20. The stitching can be of stainless steel, cotton or synthetic resin, e.g. polyester threads.

The fabric is preferably an Inox 316L stainless steel fabric with a mesh number 440 in terms of the French inch (27.77 mm) with a thread diameter of 0.28 mm, an interthread spacing of 0.0351 mm, a number of mesh openings per $cm^2$ of 24,964, an open area of 30.75% and a weight in $kg/m^2$ of 0.166. The fabric can be embossed with patterns generally in the same manner that leather is embossed and can have, for example, an alligator skin texture, a company logo or any other pattern embossed in the outer layer or on the inner layers.

Figure 3:
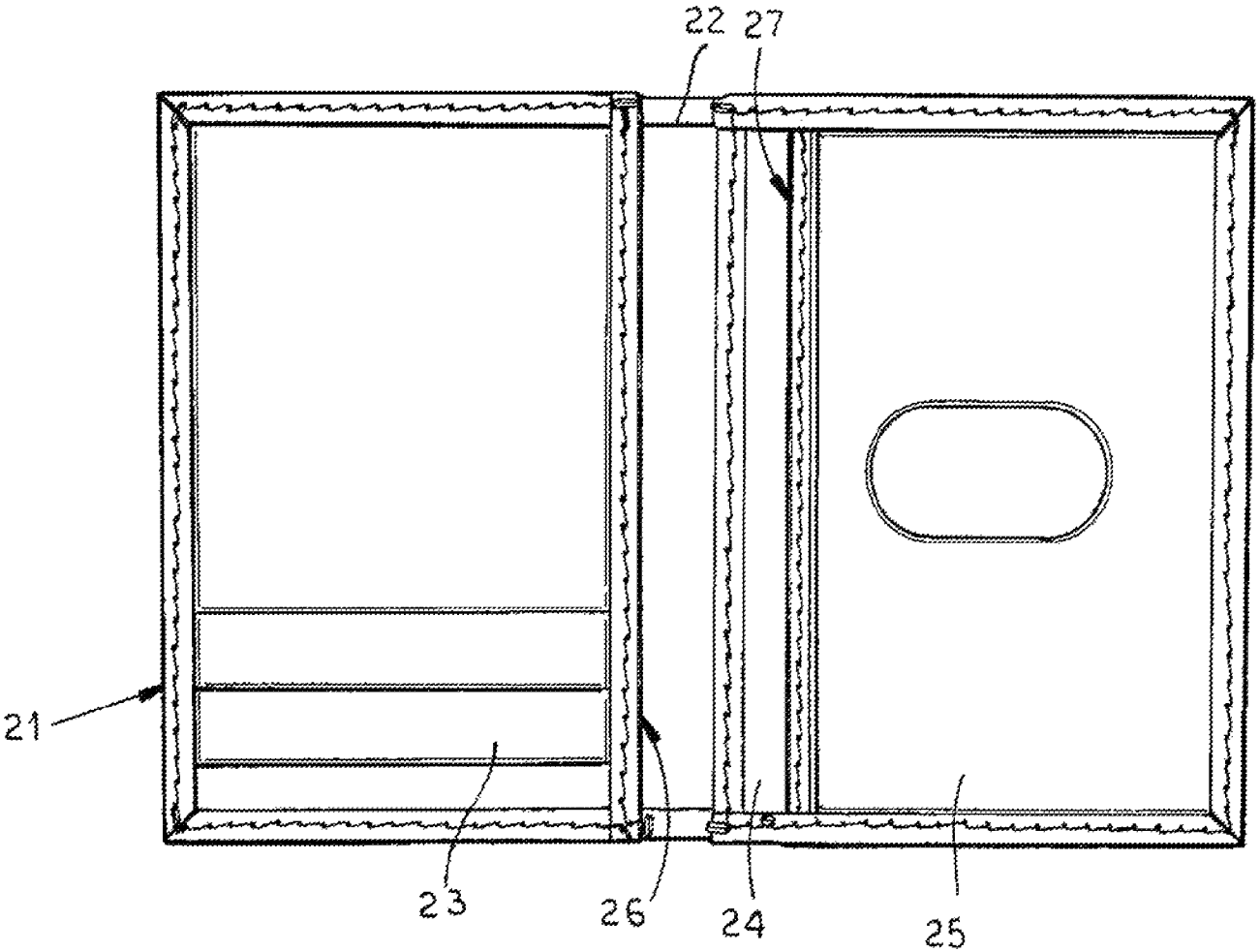
FIG. 3 is a view similar to FIG. 1 of another embodiment.
Figure 4:
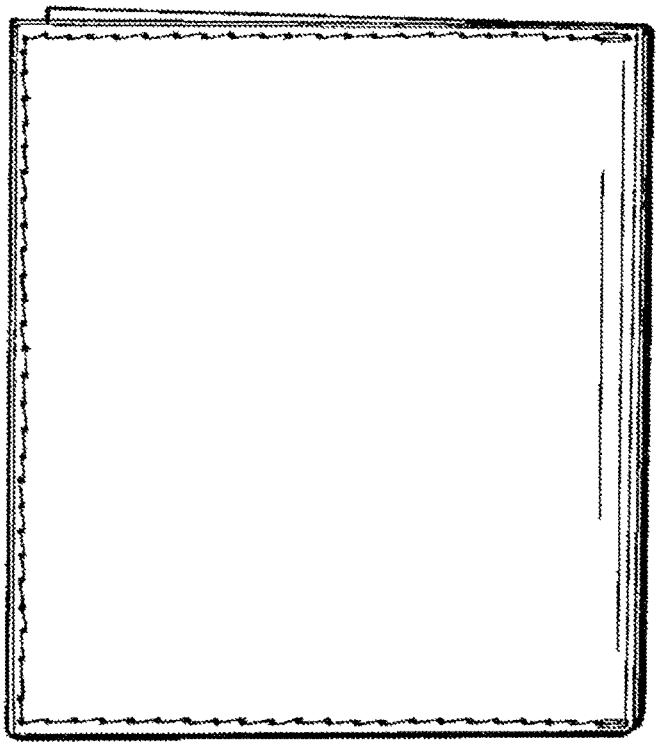
FIG. 4 is a view of the wallet of FIG. 3 in a closed position.
Figure 5:
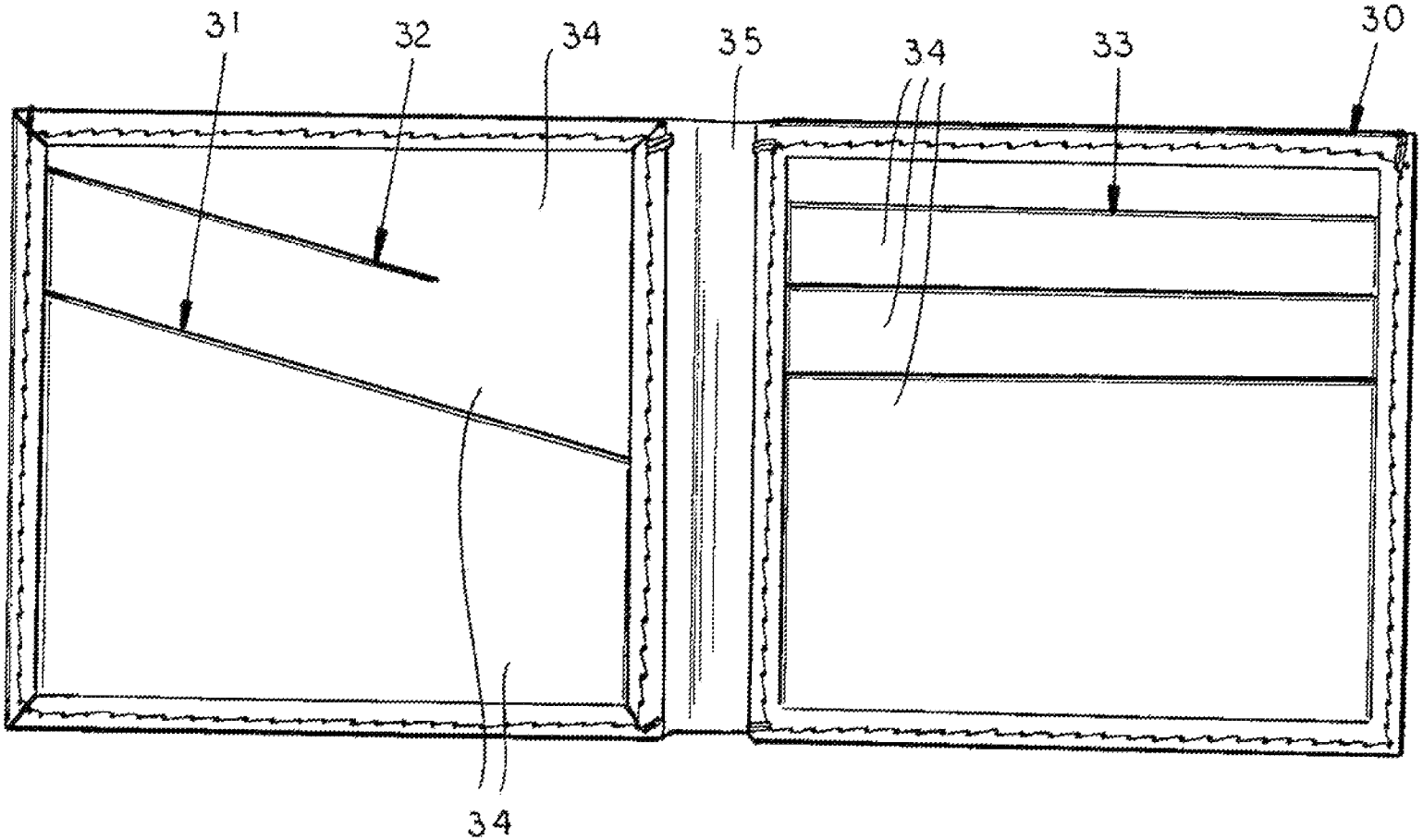
FIG. 5 is an open front view of still another wallet.
Figure 6:
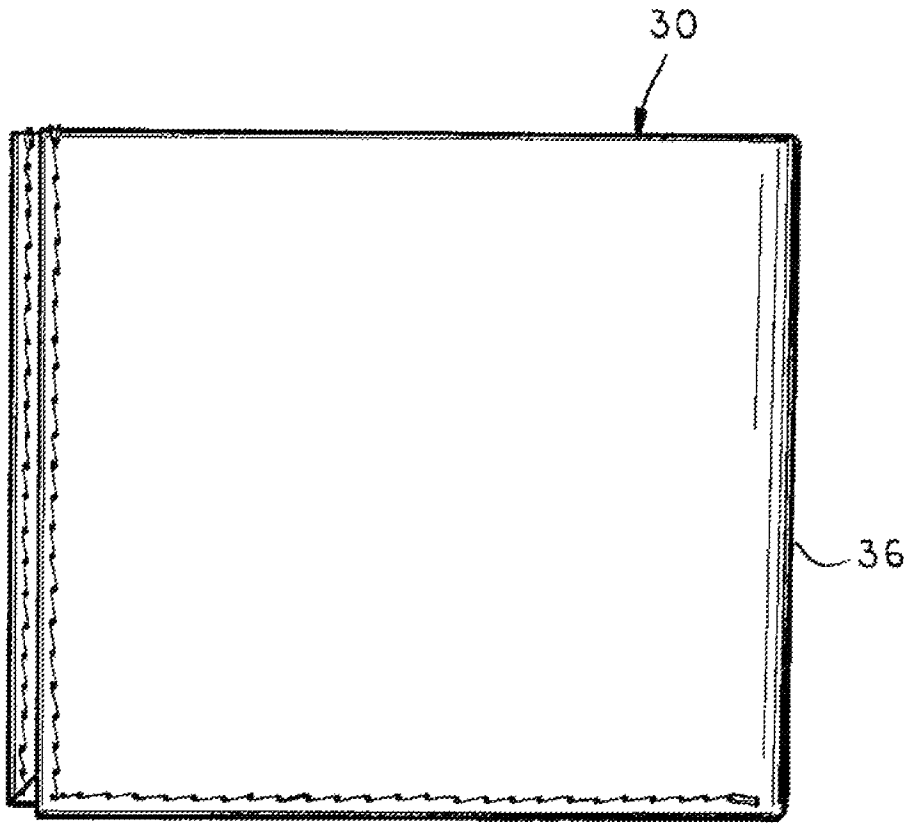
FIG. 6 is a view of the latter wallet in a closed position.
Figure 7:
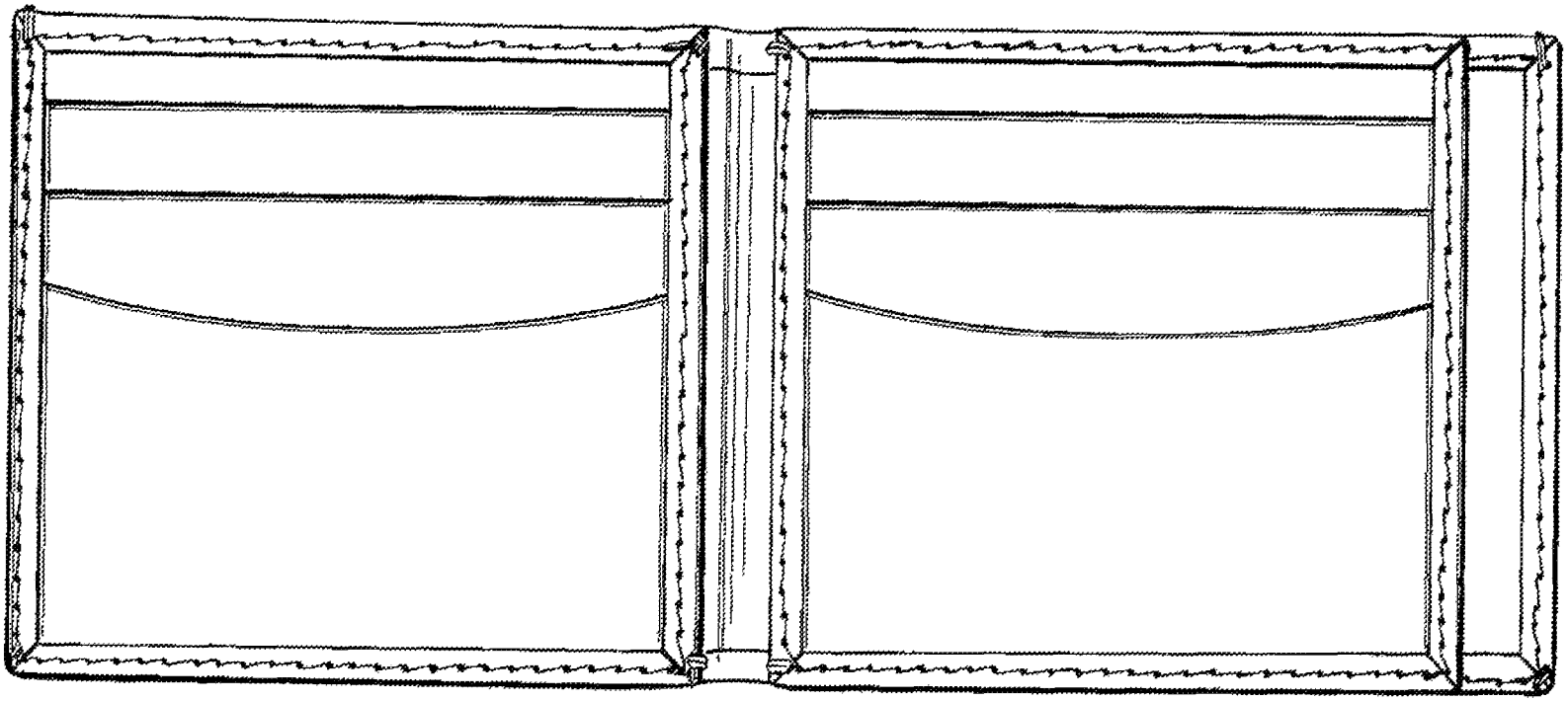
FIG. 7 is a front view of a fourth embodiment.
Figure 8:
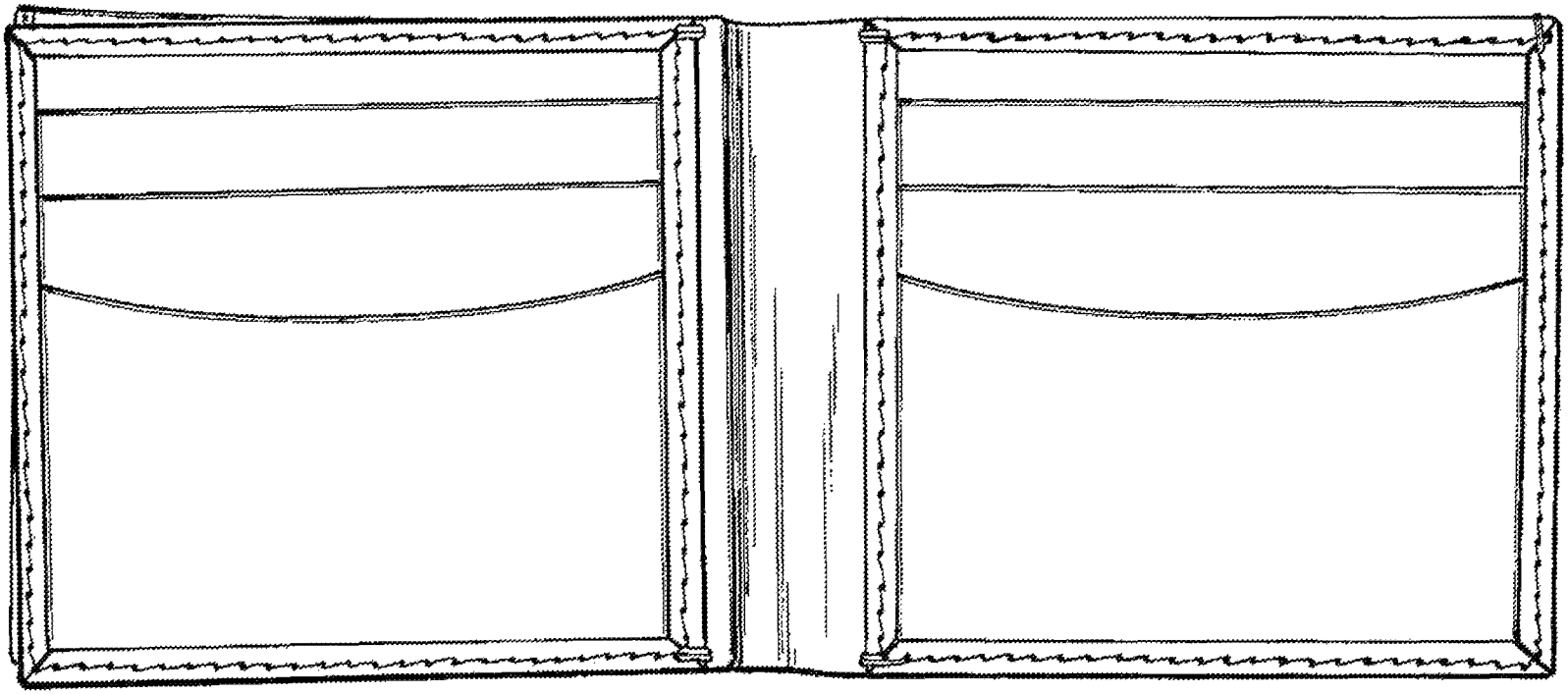
FIG. 8 is a front view of still another embodiment.

In FIGS. 3 and 4, I show a folding wallet 21 in which the backing layer 22 is provided with three front layers 23, 24, 25 forming two pockets 26 and 27. The wallet of FIGS. 5 and 6 is a folding wallet with inclined pockets at 31 and 32 and straight pockets at 33, etc, formed by the stainless steel front panels 34 and the back panel 35. The wallet 30 has a fold at 36 and in spite of the superimposed layers of the stainless steel fabric, is very flat, even when folded. Different pocket patterns are shown in the embodiments of FIGS. 7 and 8.

I have also found that the stainless steel fabric can be formed into other articles besides wallets. These include sheaths, compass holders, walkie talkie holders, pillow and cushion cases, wine bags, pencil cases, messenger bags, handbags, cosmetic bags, lipstick cases, clutches, purses, toiletry bags, diaper bags, travel bags, eyeglass cases, portfolio cases, file cases, computer bags, change purses, camera cases, MP3 player cases and cases for IPOD's, PDA devices, cell phones and the like. The fabric may be used also in the formation of book marks, shoe bags, key cases or chains, for pocket agendas, cigar cases and cigarette cases, folio covers and envelopes and picture frames, belts, pet collars, leashes, lamp shades and napkin rings.

While specific wallet designs have been described, other wallet forms may be used in general include bifold, trifold, billfold, breast pocket wallets, vertical wallets, business card cases, credit card cases, passport cases, zip around cases, money clips, checkbook covers and money clip covers.

For the wallets described specifically and these additional items, practically in all cases, a logo, pattern, design or the like will be impressed on at least the outer surface of the article and leather or alligator skin patterns may be similarly applied. All of these are deemed to be included within the scope of the invention.

I claim:

1. In combination with a smart card having an RFID tag, a wallet comprising a back layer and a plurality of front layers stitched to the back layer around part of a perimeter thereof to define a plurality of pockets in the wallet dimensioned to hold and completely surround the smart card, all of the layers being composed of a stainless steel woven mesh fabric capable of blocking RF radiation.

2. The combination defined in claim 1 wherein the stainless steel fabric is composed of an Inox alloy.

3. The combination defined in claim 1 wherein the stainless steel fabric has a metric mesh number between 350 and 550 and is composed of woven stainless steel threads with a thickness of substantially 0.25 to 0.35 mm.

4. The combination defined in claim 3 wherein the threads are composed of Inox 316L stainless steel.

5. The combination defined in claim 4 wherein the mesh number is 440 and the thread thickness is 0.28 mm.

6. The combination defined in claim 1 wherein the wallet has at least one fold.

7. The combination defined in claim 6 wherein at least one of the layers is embossed with a pattern.

* * * * *